US010918178B1

(12) United States Patent
Marsh

(10) Patent No.: US 10,918,178 B1
(45) Date of Patent: Feb. 16, 2021

(54) ADAPTABLE HANDBAG SYSTEM AND METHOD OF USE

(71) Applicant: Chae An Marsh, Dallas, TX (US)

(72) Inventor: Chae An Marsh, Dallas, TX (US)

( * ) Notice: Subject to any disclaimer, the term of this patent is extended or adjusted under 35 U.S.C. 154(b) by 0 days.

(21) Appl. No.: 15/903,011

(22) Filed: Feb. 22, 2018

Related U.S. Application Data

(60) Provisional application No. 62/462,214, filed on Feb. 22, 2017.

(51) Int. Cl.
*A45C 7/00* (2006.01)
*A45C 1/02* (2006.01)

(52) U.S. Cl.
CPC ..... *A45C 7/0086* (2013.01); *A45C 1/024* (2013.01); *A45C 2001/026* (2013.01)

(58) Field of Classification Search
CPC .. A45C 7/0086; A45C 1/024; A45C 2001/026
See application file for complete search history.

(56) References Cited

U.S. PATENT DOCUMENTS

| | | | | | |
|---|---|---|---|---|---|
| 910,619 | A * | 1/1909 | Weidemann | A45C 3/06 | |
| 1,113,821 | A * | 10/1914 | Partmann | A45C 3/06 | 150/110 |
| 1,513,463 | A * | 10/1924 | Kidder | A45C 3/04 | 383/71 |
| 1,815,912 | A * | 7/1931 | Hiering | A45C 3/06 | 224/217 |
| 4,037,633 | A * | 7/1977 | Gordon | A45C 13/26 | 150/110 |
| 5,826,714 | A * | 10/1998 | Martin | A45C 3/00 | 206/232 |
| 9,078,503 | B1 * | 7/2015 | Gilman | A45C 13/20 | |
| 9,113,685 | B2 * | 8/2015 | Iwai | A45C 3/06 | |
| 2009/0194571 | A1 * | 8/2009 | Evans | A45C 13/30 | 224/578 |

* cited by examiner

*Primary Examiner* — Tri M Mai
(74) *Attorney, Agent, or Firm* — Richard Eldredge; Eldredge Law Firm

(57) ABSTRACT

An adaptable handbag system enables a user to customize the capacity of their hand bag by adding or removing bags from a carrying ring. The bags are attached to the ring via a hinge and attachment point to allow the bag to move with respect to the carrying ring. The bags have different shapes and markings to allow for quick identification even in less than optimal viewing conditions.

1 Claim, 6 Drawing Sheets

ADAPTABLE HANDBAG SYSTEM AND METHOD OF USE

BACKGROUND

1. Field of the Invention

The present invention relates generally to bags, and more specifically, to handbags for carrying personal belongings with user wherever they go.

2. Description of Related Art

Bag are well known in the art and are effective means to transport and store objects. For example, FIG. 1 depicts a conventional handbag 101 having a bag 103 with handles 105. During use, items 107 are deposited in the bag 103 and it is carried about by the handles 105.

One of the problems commonly associated with system 101 is its limited efficiency. For example, items 107 stored in the bag 103 become jumbled and making it difficult to locate a particular item 107 in the bag 103.

Additionally, a particular handbag 101 may not be appropriate for multiple settings such a carrying it at a park and a formal dinner.

Accordingly, although great strides have been made in the area of handbags, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
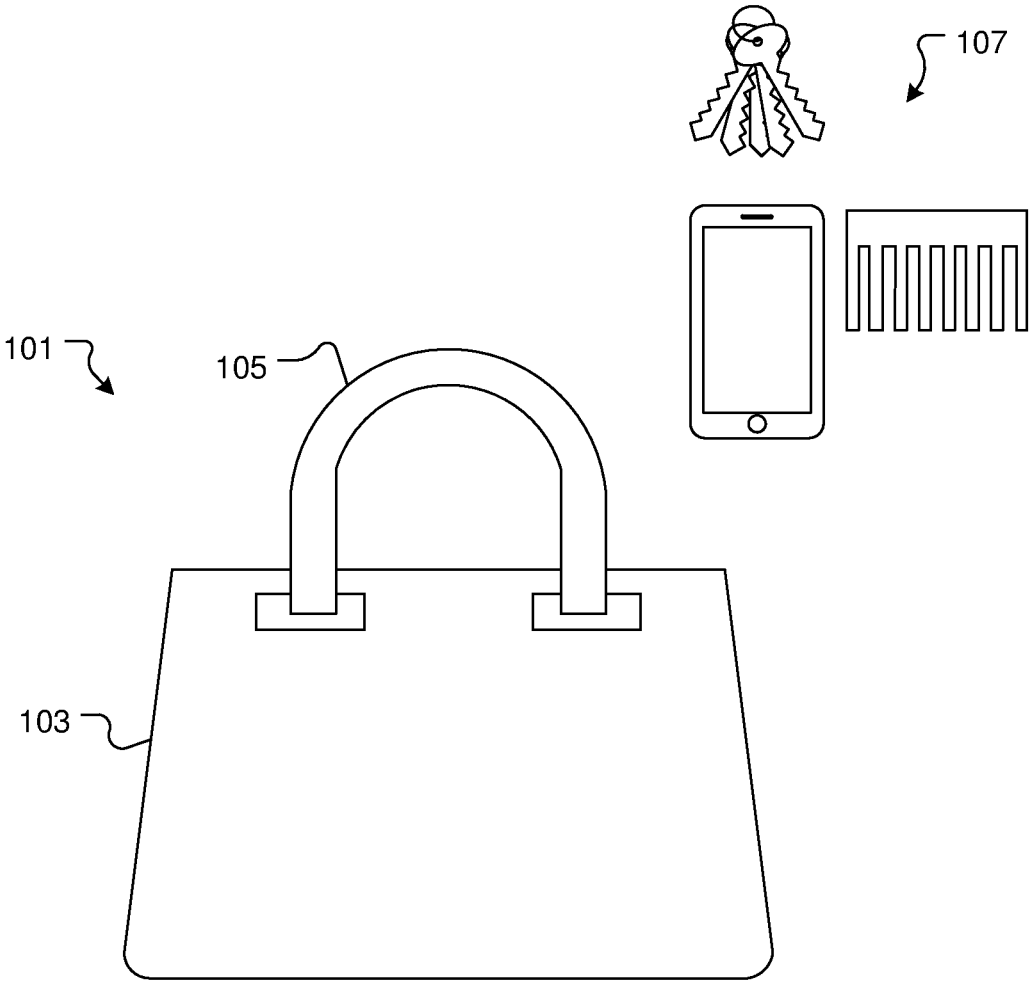
FIG. 1 (Prior Art)
FIG. 1 is a side view of a common handbag.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional handbags. Specifically, the system of the present application enables the customization of a handbag so that items are neatly organized and easy to locate. In addition, they system can be modified so as to be appropriate for multiple occasions. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
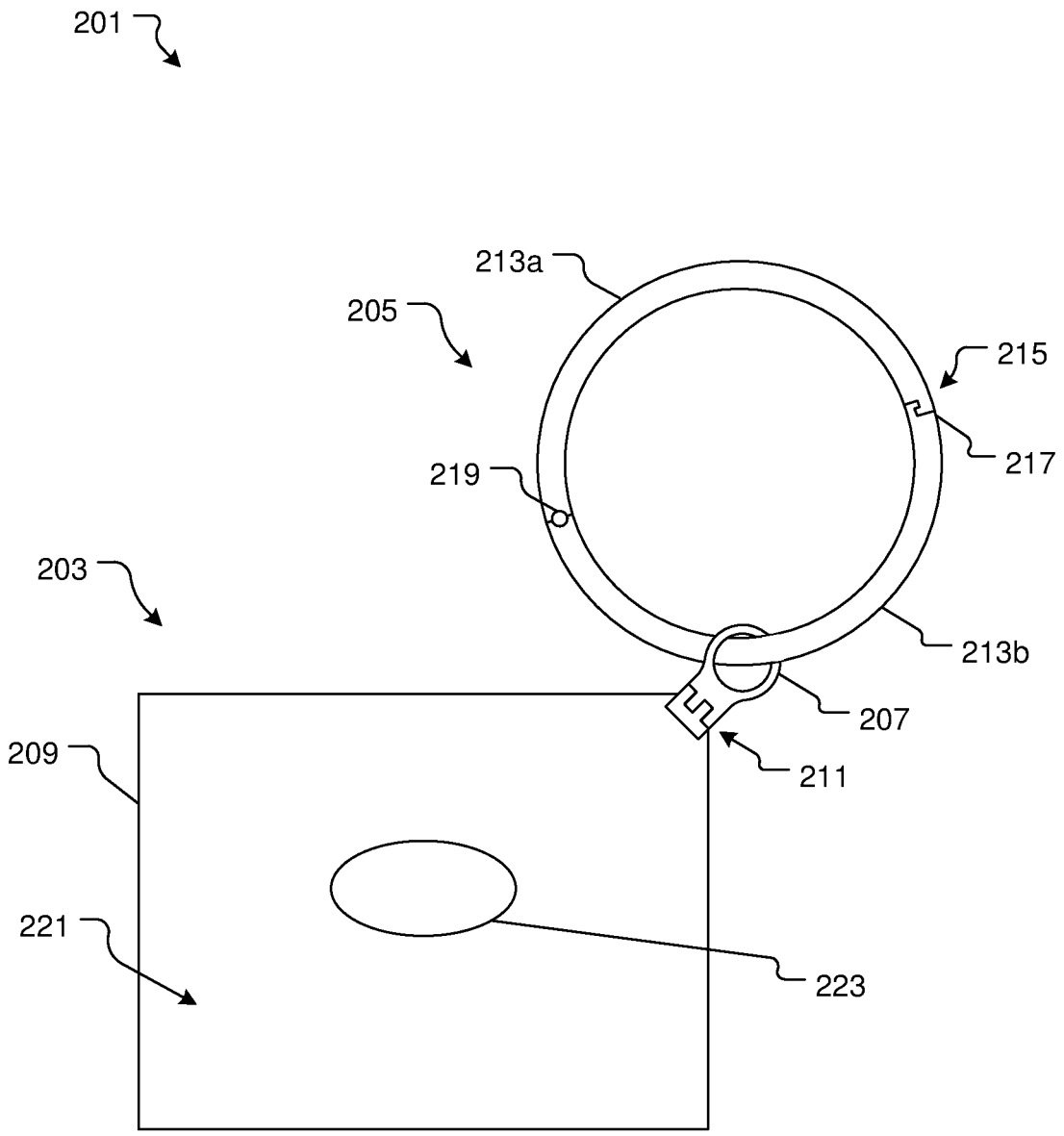
FIG. 2 is a side view of an adaptable handbag system in accordance with a preferred embodiment of the present application.

Referring now to the drawings wherein like reference characters identify corresponding or similar elements throughout the several views, FIG. 2 depicts a side view of an adaptable handbag system in accordance with a preferred embodiment of the present application. It will be appreciated that system 201 overcomes one or more of the above-listed problems commonly associated with conventional handbags.

In the contemplated embodiment, system 201 includes at least one bag removably 203 attached to a carrying ring 205.

Figure 3:
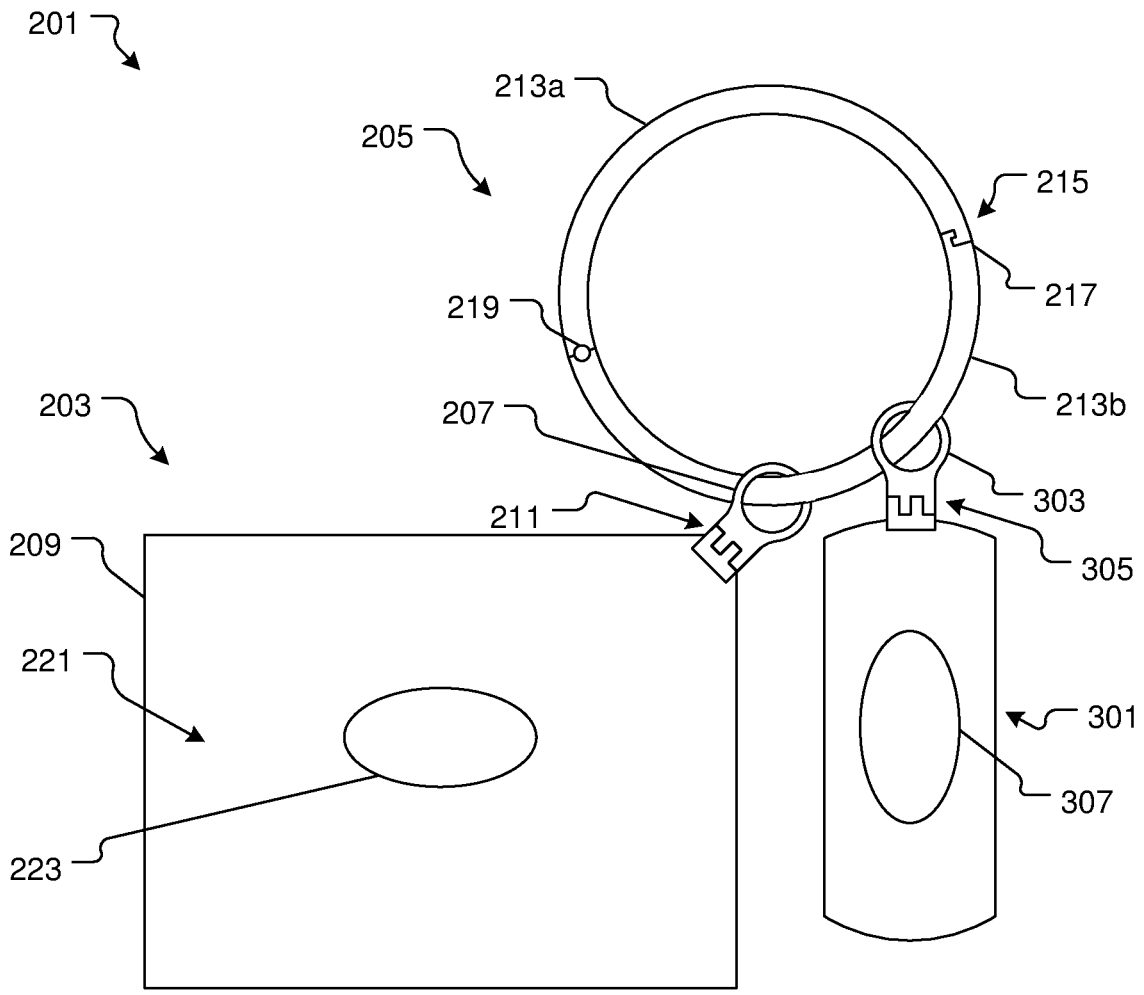
FIG. 3 is a side view of an the system of FIG. 2 with multiple bags.

Bag 203 having at least one attachment point 207 flexible attached to a body 209 via hinge 211. The bag 203 also having an exterior surface 221 with indicia 223. The indicia 223 and the shape of the bag 203 serve to facilitate identification of the bag 203 when more than one are attached to ring 205 as depicted in FIG. 3. It will be appreciated that under low lighting bags 203, 301 are difficult to identify and that having various shapes and indicia 223 would greatly simply this task. It will also be appreciated that different bags 203 could be used to store similar items e.g. baby care, beauty products or monetary items.

The carrying ring 205 forming a body 213 with an access point 215 where bags 203 are attached to or removed from ring 205. In this embodiment access point 215 is depicted as a latch 217 and a hinge 219 at the opposite side of the ring 205.

It should be appreciated that one of the unique features believed characteristic of the present application is that the quantity and capacity of bags 203, 301 can be adapted for any situation thus facilitating organizing items to be stored in the bags 203, 301. It will be appreciated that each bag 203, 301 could carry items of a related nature.

Another unique feature believed characteristic of the present application is that bags 203, 301 have indicia 223, 307 that along with the shape of the bags 203, 301 facilitate identifying the contents of the bag 203, 301 in various situations.

Figure 4:
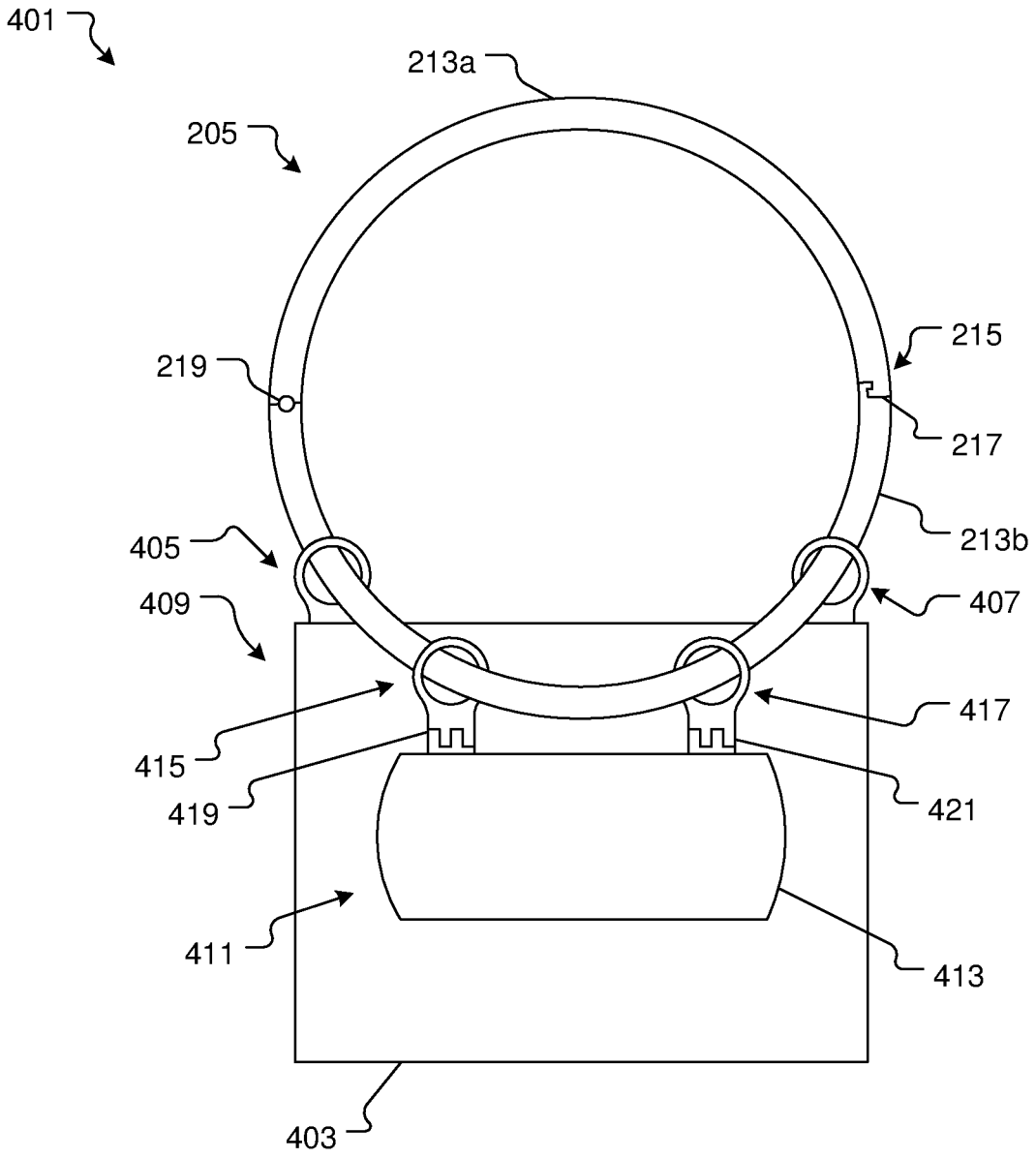
FIG. 4 is a side view of an alternative embodiment of the system of FIG. 2.

Referring now to FIG. 4 an alternative embodiment of bag 203 is depicted. The embodiment 401 having a first bag 409 including a body 403 with a plurality of attachment points 405, 407 that are configured to allow the bag to attach to ring 205 is a more stable manner than by a single attachment point 207. The embodiment 401 includes a second bag 411 having a body 413 configured to carry items. The bag 411 having a plurality of attachment points 415, 417 connected to body 413 via hinges 419, 421. It will also be appreciate that while bag 401 has a plurality of attachment points 405, 407 that only one could be used.

Figure 5:
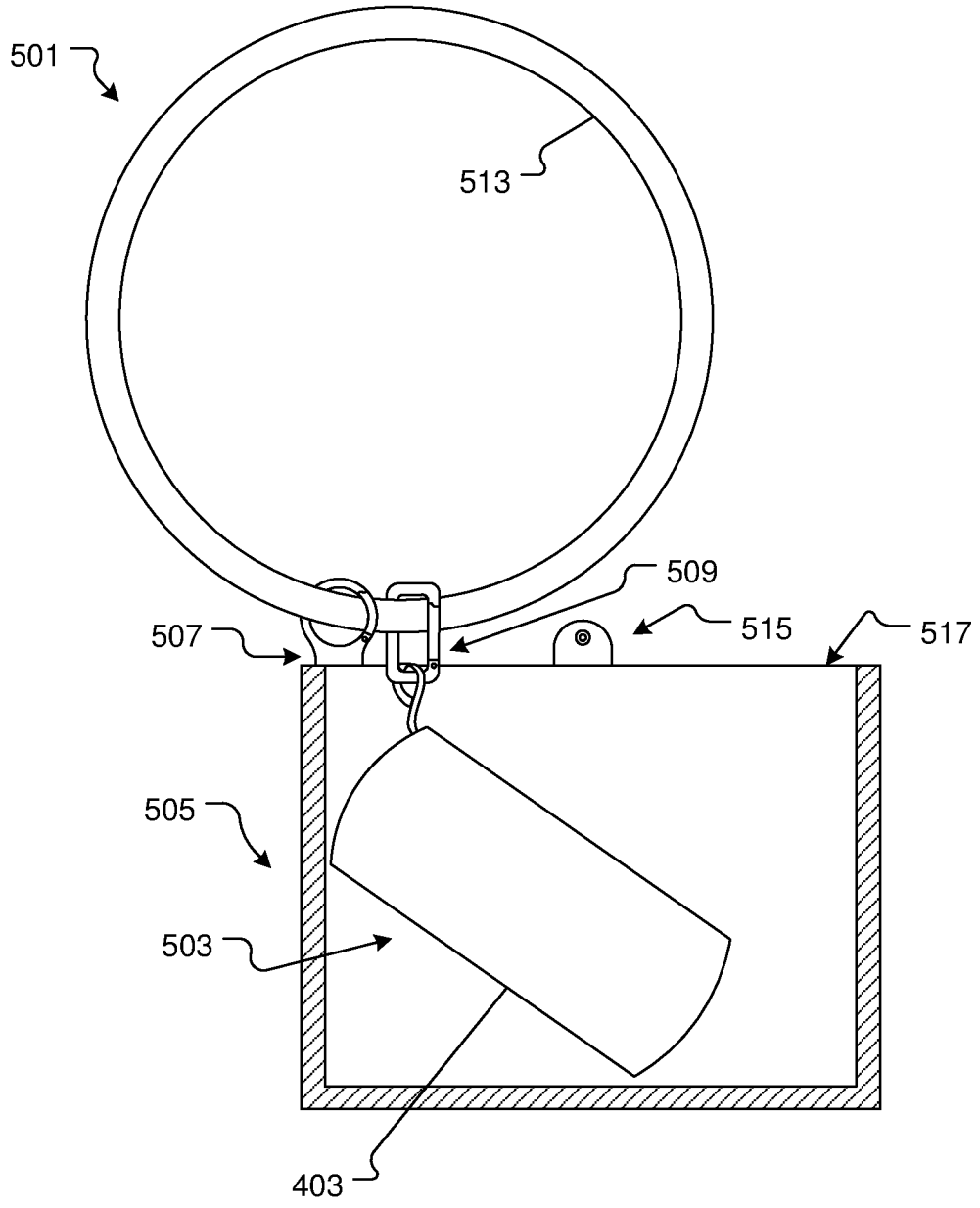
FIG. 5 is a cross-sectional side view of alternative embodiment of the system of FIG. 2.

It is contemplated that it would be beneficial to conceal a smaller bag 503, within a lager bag 505 either for security or privacy as depicted in FIG. 5. Embodiment 501 including a first bag 503 and a second bag temporarily attached via attachment points 507 and 509 respectively. Bag 505 is configured so that bag 503 fits within body 511 of bag 505. Bag 505 so having a fastener 515 at its top edge 517 to close bag 505 around bag 503.

Attachment points 507 and 509 are removably attached to the ring 513. It will be appreciated that in this embodiment ring 513 is of a solid construction.

Figure 6:
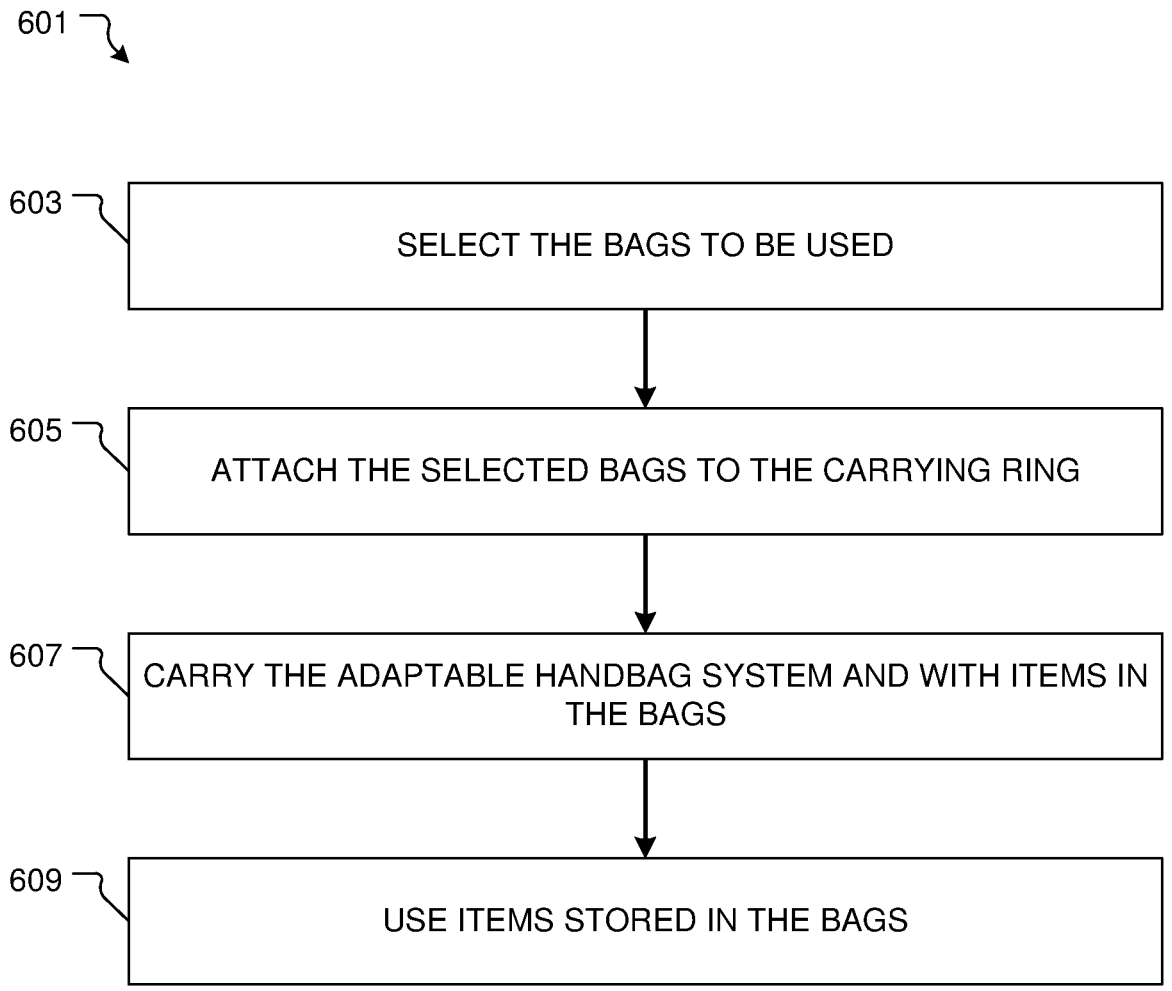
FIG. 6 is a flowchart of the preferred method of use of the system of FIG. 2.

Referring now to FIG. 6 the preferred method of use of system 201 is depicted. Method 601 including selecting the bags to be used 603, attaching the bags to the carrying ring 605, carrying the adaptable handbag system 607 and using items stored in the bags 609.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. An adaptable handbag system comprising:

a first bag having:

a body forming a cavity configured to carry items therein, the body forming an opening and a peripheral edge around the opening;

a first looped attachment having a first hole and secured to the peripheral edge;

a second looped attachment secured having a second hole and secured to the peripheral edge and positioned at a distance relative to the first looped attachment;

a ring having:

a first member;

a second member;

a pivot joint attached to the first member and the second member, the pivot joint is configured to allow the first member to pivot relative to the second member;

a latch configured to secure the first member to the second member;

wherein the ring extends through the first hole and the second hole of respective first looped attachment and second looped attachment;

a second bag having:

a first hinged looped attachment; and a second hinged looped attachment;

wherein the first hinged looped attachment and the second hinged looped attachment slidingly engaged to the ring.

* * * * *